US007530430B2

(12) United States Patent
Hoang et al.

(10) Patent No.: US 7,530,430 B2
(45) Date of Patent: May 12, 2009

(54) PRESSURE LUBRICATION FOR INVERTED FLIGHT

(75) Inventors: Tuyen Trong Hoang, Montreal (CA); Constantin Catanu, Montreal (CA); Daniel Grigore, Pointe Claire (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 734 days.

(21) Appl. No.: 10/980,231

(22) Filed: Nov. 4, 2004

(65) Prior Publication Data

US 2006/0090964 A1 May 4, 2006

(51) Int. Cl.
*F01M 3/00* (2006.01)
*F16K 17/36* (2006.01)

(52) U.S. Cl. ..... 184/6.2; 184/33; 184/81; 137/38; 137/44; 137/112

(58) Field of Classification Search ..... 184/33–35, 184/81, 6.2, 6; 60/39.08; 137/38, 41, 44; 244/1 R
See application file for complete search history.

(56) References Cited

U.S. PATENT DOCUMENTS 1,845,136 A 2/1932 Dieter
2,245,198 A 6/1941 Hunter et al.
2,379,579 A 7/1945 Hunter
2,399,323 A * 4/1946 Chester ..... 137/38
2,770,245 A 11/1956 Jay
2,831,490 A 4/1958 Simcock
2,860,648 A 11/1958 Harrison
2,933,095 A 4/1960 Rumsey
2,934,077 A 4/1960 Whiting
3,500,750 A 3/1970 Vohl
4,252,140 A 2/1981 Hildebrandt
4,531,358 A 7/1985 Smith
4,813,445 A * 3/1989 Lu ..... 137/38
4,947,963 A 8/1990 Aho, Jr.
4,974,410 A 12/1990 Wright et al.
5,346,104 A * 9/1994 Jeong ..... 222/402.19
6,463,819 B1 10/2002 Rago
2004/0244832 A1 * 12/2004 Sonnleitner et al. ..... 137/38

* cited by examiner

*Primary Examiner*—Robert A Siconolfi
*Assistant Examiner*—Thomas W Irvin
(74) *Attorney, Agent, or Firm*—Ogilvy Renault LLP

(57) ABSTRACT

A gravity controlled lubrication system for aircraft engines to supply a lubricant from a tank to a circulating system permitting lubricant to flow when the aircraft changes to an inverted flight condition.

17 Claims, 4 Drawing Sheets

PRESSURE LUBRICATION FOR INVERTED FLIGHT

FIELD OF THE INVENTION

The present invention relates to a lubrication system for an aircraft gas turbine engine, and relates in particular to a lubrication system which provides an uninterrupted supply of lubricant when the is in an inverted flight condition.

BACKGROUND OF THE INVENTION

Many proposals have been made to avoid the problems associated with lubricant starvation in bearing chambers when, for example, an aircraft takes up an inverted flight condition and the lubricant in the tank moves away from the pump inlet, which prevents the pump from supplying any lubricant. The proposals usually involve baffles within the tank in order to maintain a reservoir of lubricant at the pump inlet during inverted flight and the positioning of the pump inlet within the reservoir, so that the pump continues to supply lubricant for a limited period.

However, there is still a need for alternative configurations and arrangements for a lubrication system of gas turbine engines which is adapted to continuously supply lubricant for engine bearings when the aircraft changes to inverted flight condition.

SUMMARY OF THE INVENTION

One object of the present invention is to provide an improved lubrication system for aircraft engines.

In accordance with one aspect of the present invention, there is a gravity controlled lubrication system provided for an engine of an aircraft, which comprises a lubricant tank for containing a lubricant therein, a pump having an outlet and an inlet, a first fluid passage for directing the lubricant in the tank to the pump inlet during a normal flight condition, and a second fluid passage isolated from the first fluid passage during the normal flight condition to direct a used lubricant flow from a lubricant returning system of the engine to the tank. A gravity controlled mechanism is provided for closing the first fluid passage to the tank and connecting the first fluid passage with the second fluid passage when the aircraft changes from the normal flight condition into a inverted flight condition, thereby a majority portion of the used lubricant flow from the lubricant returning system directly entering the pump inlet without passing through the tank.

In accordance with another aspect of the present invention, there is a gravity controlled lubrication system provided for an engine of aircraft, which comprises a lubricant tank for containing a lubricant therein, a pump having an outlet and an inlet, and a valve assembly. The valve assembly includes a valve body defining a cavity therein and a valve member positioned in a first position within the cavity and moveable under the gravity thereof from the first position to a second position within the cavity when the aircraft changes to an inverted flight condition. The valve body further defines first, second, third and fourth openings therein in fluid communication with the cavity. The first opening is connected to a first tube terminating within the tank at a bottom thereof. The second opening is connected to the inlet of the pump. The third opening is connected to a lubricant returning system of the engine. The fourth opening is in fluid communication with the inside of the tank. The valve member when being positioned in the first position divides the cavity into isolated sections to permit a first fluid passage between the first and second openings and a second fluid passage between the third and fourth openings, respectively. The valve member when moving into the second position closes the fourth opening and permits fluid communication within the cavity between the first, second and third openings.

In accordance with a further aspect of the present invention there is a method for pumping a lubricant to a lubricant circulating system of an engine of an aircraft when the aircraft changes from a normal flight condition to an inverted flight condition. The method comprises during the normal flight condition, pumping the lubricant to the lubricant circulating system using a pump to suck the lubricant from a tank through a pump inlet passage while directing a used lubricant flow from the lubricant circulating system through a returning passage into the tank; and when the aircraft change to the inverted flight condition, using a gravity controlled mechanism to shift the returning passage from fluid communication with the tank to fluid communication directly with the pump inlet passage such that the pump sucks the lubricant directly from the used lubricant flow rather than from the tank.

The present invention provides a simple configuration of a lubricating system for aircraft engines to solve the lubricant starvation problem in engine bearings for a limited period of time when the aircraft changes to the inverted flight condition.

Other features and advantages of the present invention will be better understood with reference to the preferred embodiments described hereinafter.

BRIEF DESCRIPTION OF THE DRAWINGS

Reference will now be made to the accompanying drawings showing by way of illustration preferred embodiments, in which.

DETAILED DESCRIPTION OF THE PREFERRED EMBODIMENT

Figure 1:
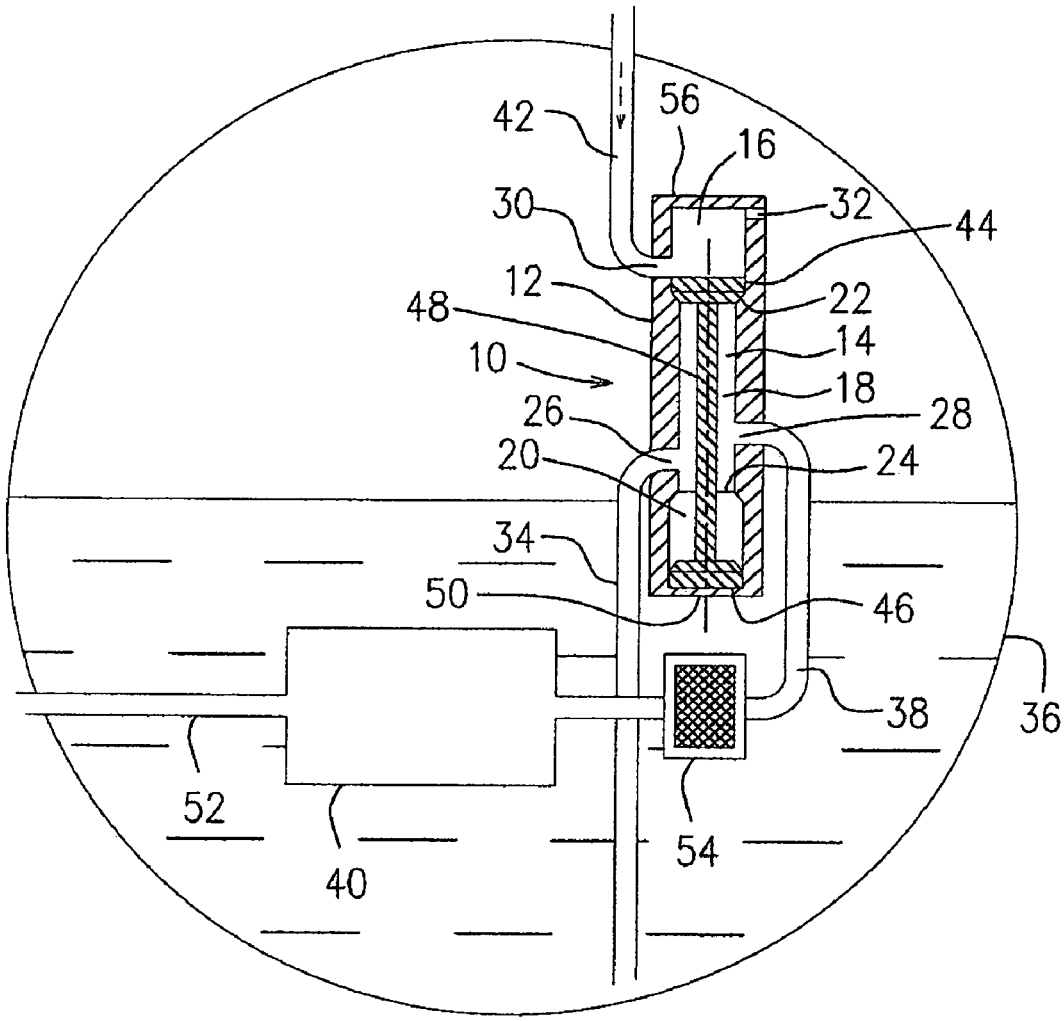
FIG. 1 is a schematic illustration showing a first embodiment of the present invention during normal flight conditions.

Referring to FIG. 1, a valve assembly 10 includes a valve body 12, for example, in a cylindrical shape, and defining a cavity 14 therein. The cavity 14 preferably includes a cylindrical upper section 16 and a lower section which is preferably divided into a middle section 18 and a bottom section 20. The middle section 18 has a diameter smaller than the upper and bottom sections 16, 20 such that the respective interfaces 22, 24 are formed with radial annular surfaces functioning as valve member seats which will be further discussed below.

The valve body 12 defines two lower openings 26, 28 in a part of the valve body 12 defining the middle section 18 of the cavity 14, and two upper openings 30, 32 in a part of the valve body 12 defining the upper section 16 of the cavity 14. The lower opening 26 is connected to a tube 34 terminating at the other end thereof within a lubricant tank 36, at the bottom thereof. The lower opening 28 is connected to an inlet tube 38 of a lubricant pump 40. The upper opening 30 is connected to a lubricant returning system of the engine, such as a lubricant cooler or scavenger (not shown), through a lubricant returning line 42. The upper opening 32 is in fluid communication with the lubricant tank 36, preferably with an inner space of the tank 36 above the lubricant level within the tank 36.

A valve member includes, for example, a piston element 44 freely moveable within the upper section 16 of the cavity 14 along a longitudinal axis (not indicated) of the valve body 12. The valve member preferably further includes another piston element 46 freely moveable within the bottom section 20 of the cavity 14 along the longitudinal axis of the valve body 12. A rod 48 extends between the two piston elements 44, 46 and interconnects same together. The piston element 44 within the upper section 16 rests on the interface 22 between the upper section 16 and the middle section 18 of the cavity 14 under the gravity thereof under normal flight conditions. Thus, the piston element 44 isolates the upper section 16 from the entire lower section including the middle section 18 and the bottom section 20 of the cavity 14. The piston element 46 and the rod 48 enhance a gravity force on the piston element 44 to secure a sealing position of the piston element 44 on the interface 22. Therefore, the piston element 46 preferably does not contact a bottom wall 50 of the cavity 14 in order to prevent interference with the isolation performance achieved by piston element 44 resting on the interface 22.

Under normal flight conditions the valve assembly 12 constitutes two isolated fluid passages. In the first passage the lubricant pump 40 sucks the lubricant contained within the lubricant tank 36 out of the pipe 34, through the middle and bottom sections 18, 20 of the cavity 14 and the inlet tube 38, and then pumps the lubricant through a pump outlet tube 52 into the lubricant circulating system of the aircraft engine (not shown). In this first passage, the tube 34 functions as an extension of the pump inlet tube 38. A filter device 54 is preferably connected in the pump inlet tube 38 such that the lubricant is filtered by the filter device 54 before entering the lubricant pump 40. In the second passage the used lubricant is delivered from the lubricant returning line 42 into the upper section 16 of the cavity 14 and through the opening 32 into the lubricant tank 36.

Figure 2:
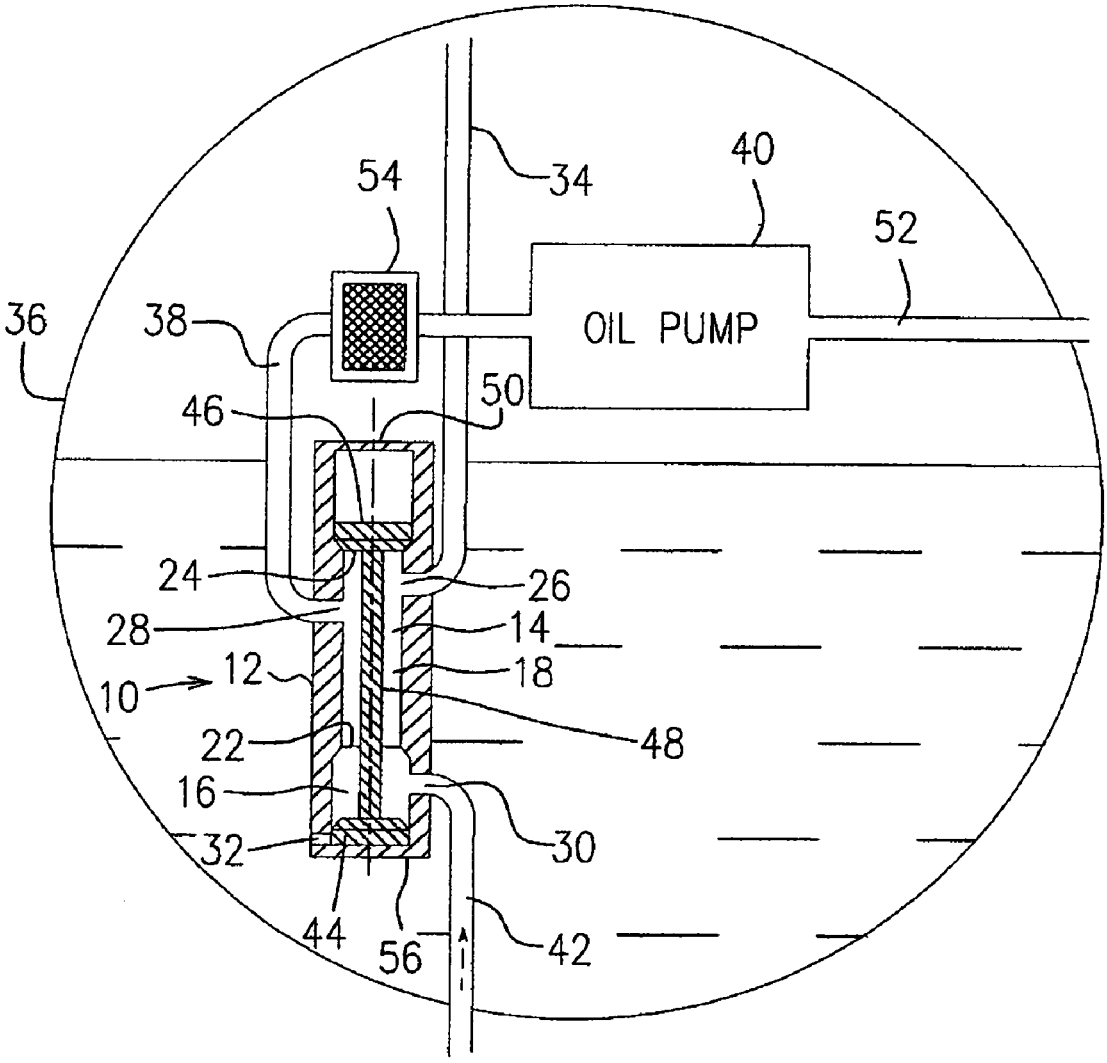
FIG. 2 is a schematic illustration of the present invention showing the first embodiment of the present invention during inverted flight conditions.

Referring to FIG. 2, when the aircraft changes to an inverted flight condition, the entire system is positioned upside down, as illustrated in FIG. 2. The opening 32 is preferably defined near a top wall 56 of the cavity 14. Therefore, the piston element 44 together with the piston element 46 and the rod 48, moves down and towards the top wall 56 (now in a lower position) of the cavity 14 and thus closes the opening 32 when the aircraft changes to the inverted flight condition.

The entire valve member can either rest on the top wall 56 (by piston element 44) or on the interface 24 (by piston element 46), provided the piston element 44 is aligned with the opening 32 to efficiently close same.

In this upside down situation, the pump 40 is no longer capable of sucking the lubricant from the tank 36 because the lubricant within the tank 36 has been collected in the top portion thereof (now in a lower position) and the opening of the tube 34 is exposed to the empty portion of the tank 36. Nevertheless, the cavity 14 of the valve assembly 10 permits fluid communication between the openings 26, 28 and 30. Thus, the used lubricant is delivered through the lubricant returning line 42 by another pumping device (not shown) in the lubricant returning system, into the upper section 16 (now in a lower position) and the middle section 18 of the cavity 14. The lubricant in the cavity 14 is sucked by the lubricant pump 40 through the pump inlet tube 38 and is pumped out through the pump outlet tube 52 into the lubricant circulating system of the aircraft engine.

It should be noted that the used lubricant usually contains a certain amount of air mixed therein even though the used lubricant may have been treated by an air/lubricant separating device (not shown) in the lubricant returning system. Therefore, the volume of the used lubricant entering the cavity 14 is usually greater than the capacity of the lubricant pump 40. The excess portion of the used lubricant flows into the tube 34 and is discharged into the tank 36.

The gravity controlled lubrication system according to another embodiment of the present invention is described with reference to FIG. 3. Components of this system similar to those in the embodiment shown in FIG. 1 are indicated by numerals in the 100 series having similar two last digits, and will not be redundantly described in detail.

The valve assembly 110 according to this embodiment defines a cavity 114 including an upper section 116 and a lower section 118 which has a diameter smaller than the diameter of the upper section 116. Thus, a valve member seat is formed on the interface 122 between the upper and lower sections 116, 118 of the cavity 114. The lower openings 126, 128 are positioned in a part of the valve body 112 defining the lower section 118 of the cavity 114. The upper openings 130, 132 are positioned in a part of the valve body 112 defining the upper section 116 of the cavity 114. In contrast to the embodiment shown in FIG. 1, the opening 132 is preferably located in a central position in the top wall 156 of the valve body 112. The inner surface of the top wall 156 and the interface 122 between the upper and lower sections 116, 118 of the cavity 114 are curved to fit the contour of a valve ball 144. The valve ball 144 is freely moveable within the upper section 116 of the cavity 114 along the longitudinal axis (not indicated) of the cylindrical cavity 114, and rests under the gravity force thereof on the interface 122 to isolate the upper section 116 from the lower section 118 of the cavity 114, thereby separating the second passage for directing the used lubricant from the lubricant returning line 142 into the tank 136, from the first passage for the lubricant pump 140 to suck the lubricant from the tank 136 through the tube 134 and the pump inlet tube 138.

Figure 4:
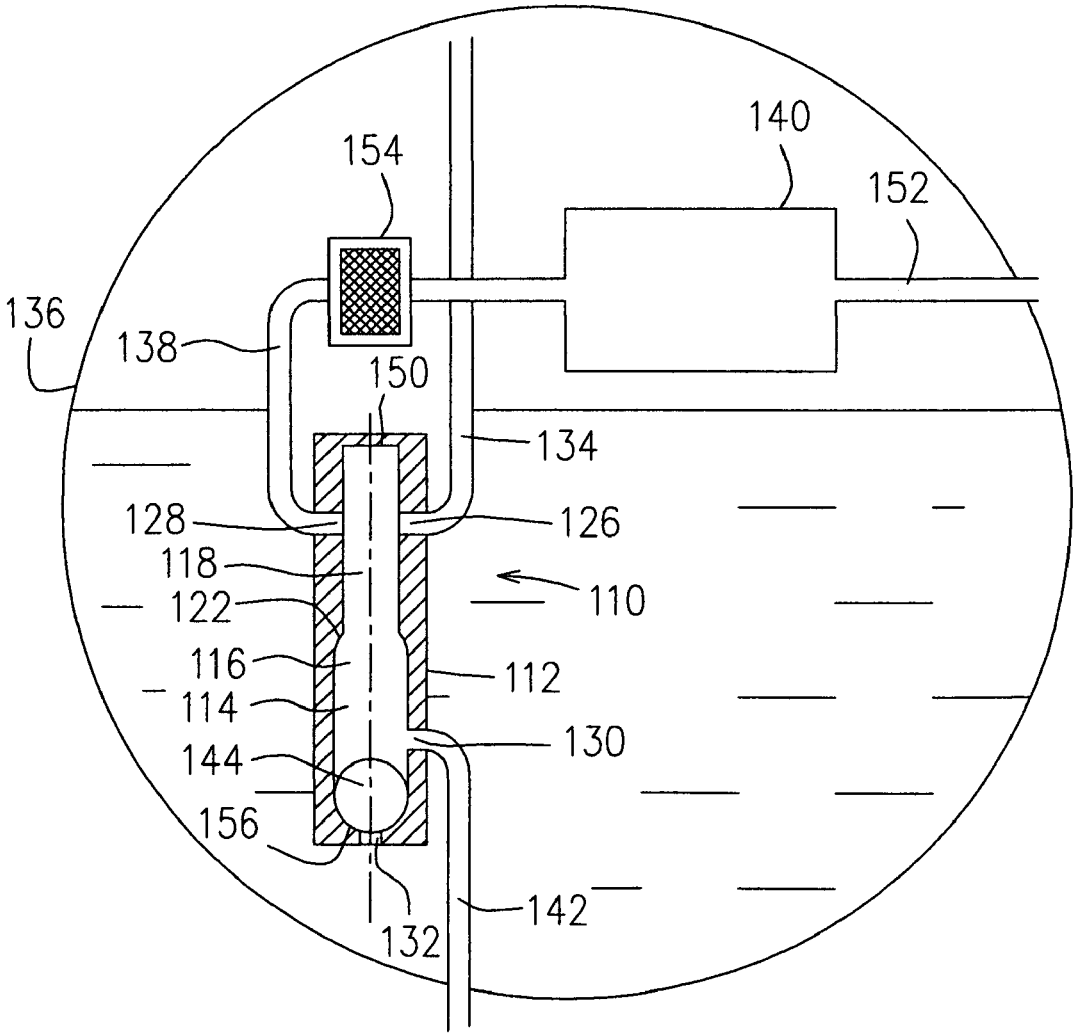
FIG. 4 is a schematic illustration showing the second embodiment of the present invention during inverted flight conditions.

Referring to FIG. 4, when the air craft changes to an inverted flight condition and the entire system turns upside down, the valve ball 144 under its gravity moves down and rests on the top wall 156 of the valve body 112 and closes the opening 132. The cavity 114 including the upper section 116 and the lower section 118 thereof permits fluid communication between the openings 126, 128 and 130, thereby permitting the lubricant pump 140 to suck the used lubricant which is delivered through the returning line 142 into the cavity 114. The excess volume of used lubricant is discharged through tube 134 into the tank 136.

Figure 3:
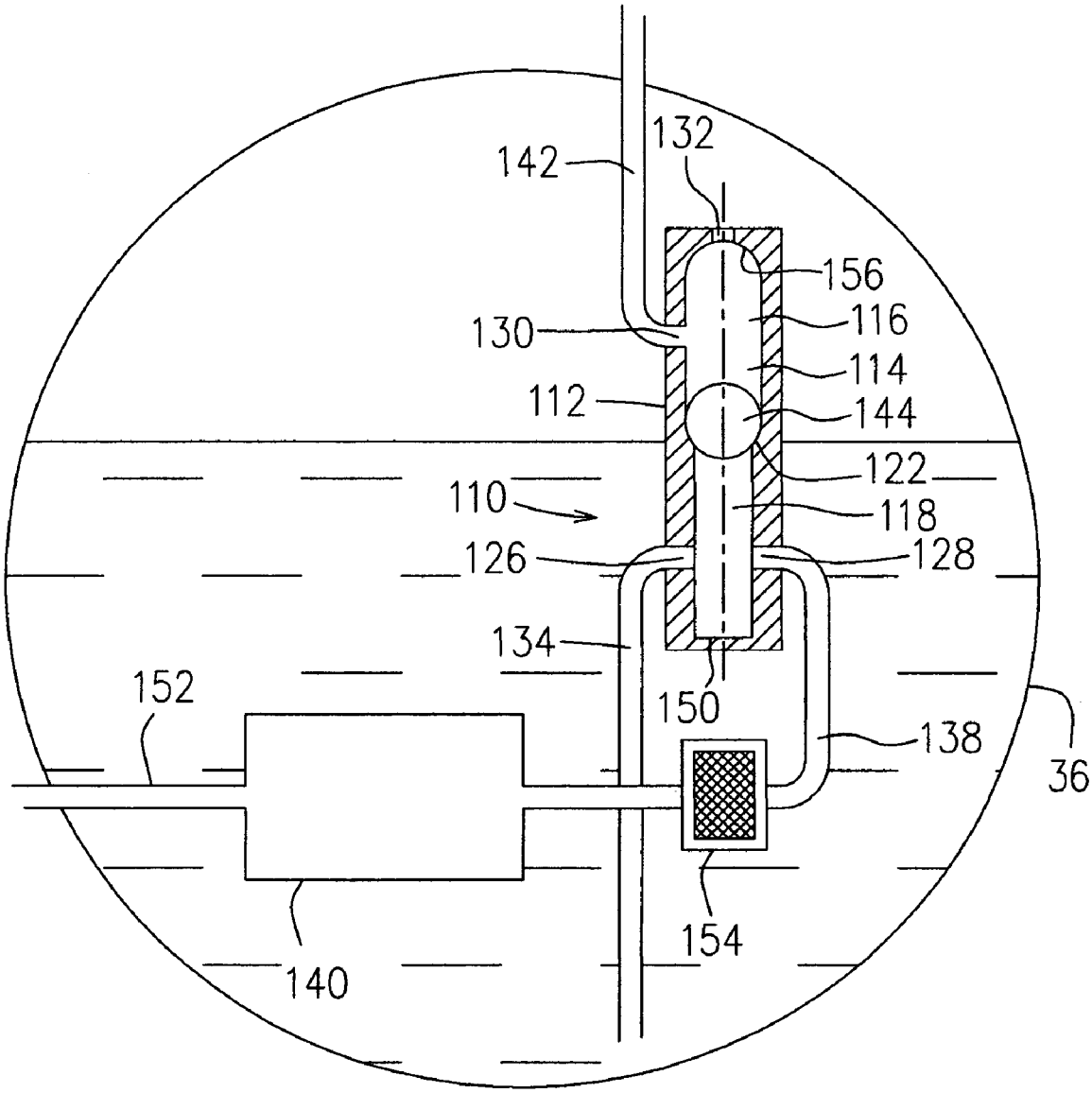
FIG. 3 is a schematic illustration showing a second embodiment of the present invention during normal flight conditions.
Figure 5:
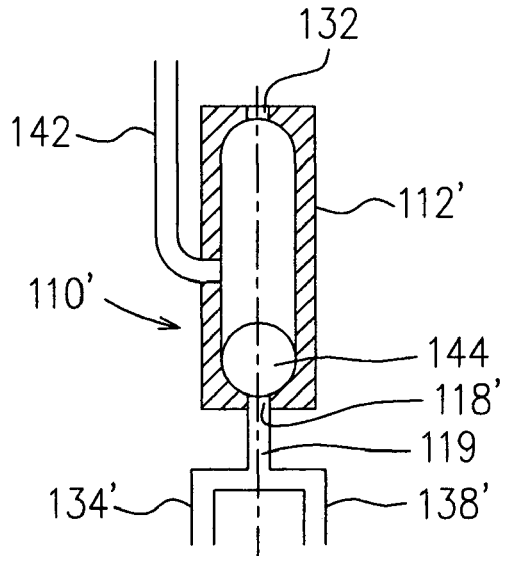
FIG. 5 is a partial schematic illustration showing the valve assembly of a third embodiment of the present invention during normal flight conditions.

In a further embodiment of the present invention as illustrated in FIG. 5 and in contrast to the embodiment shown in FIG. 3, the valve assembly 110' includes the valve body 112' similar to the valve body 112 of FIG. 3, but shortened. The lower section 118 of cavity 114 in FIG. 3 is shortened to form a lower opening 118', in the embodiment of FIG. 5. Corresponding to tube 134 and the pump inlet tube 138 shown in FIG. 3, this embodiment includes tube 134' integrated with and thus forming an integral section of the pump inlet tube 138'. A connecting tube 119 is used to connect the tube 134' and the pipe inlet tube 138' to the opening 118'. This embodiment has a substantially similar configuration with the embodiment of FIG. 3, but the valve body is simplified and fluid communication between the valve assembly 110' and the tube 134' and the pump inlet tube 138', is established through the connecting tube 119 rather than the internal configuration of the valve body, as shown in the embodiment of FIG. 3.

The valve assembly in the above described embodiments is preferably positioned within the lubricant tank. Nevertheless, the valve assembly can be positioned outside of the tank and provides equal function, provided that an appropriate tube is connected to the upper opening 32 of FIG. 1 and 132 of FIG. 3 in order to discharge used lubricant into the tank during normal flight conditions. The pump can be located either within the tank or outside of the tank depending on the individual design of the entire lubricant circulating system of the aircraft engine.

It should be noted that the lubrication system according to the present invention is intended for use during a limited period of time of inverted flight conditions because a small amount of used lubricant from the returning line is not re-pumped into the lubricant circulating system, but enters the tank.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

We claim:

1. A gravity controlled lubrication system for an engine of an aircraft, comprising:

a. a lubricant tank for containing a lubricant therein;

b. a pump having an outlet and an inlet;

c. a first fluid passage for directing a used lubricant flow from a lubricant returning system of the engine to the tank during a normal flight condition;

d. a second fluid passage isolated from the first fluid passage for directing the lubricant in the tank to the pump inlet during the normal flight condition; and e. a gravity controlled mechanism which includes a valve member actuated by its own weight for closing the second fluid passage to the tank and connecting the second fluid passage with the first fluid passage when the aircraft changes from the normal flight condition into an inverted flight condition, thereby a majority portion of the used lubricant flow from the lubricant returning system directly entering the pump inlet without passing through the tank.

2. The system as claimed in claim 1 wherein the gravity controlled mechanism comprises a valve assembly connected to the tank and the pump, the valve assembly including a valve body defining a cavity therein with a plurality of openings, and the valve member positioned in a first position within the cavity during the normal flight condition and moveable under the gravity thereof from e first position to a second position within the cavity when the aircraft changes to an inverted flight condition, the cavity permitting fluid communication between the tank and the lubricant returning system and preventing fluid communication through the cavity between the lubricant returning system and the inlet of the pump when the valve member is in the first position, and the cavity permitting fluid communication through the cavity between the lubricant returning system and the inlet of the pump and permitting fluid communication between the lubricant returning system and the tank only through the cavity and the second fluid passage when the valve member is in the second position.

3. The system as claimed in claim 2 wherein the valve body comprises a first opening in fluid communication with the inlet of the pump, a second opening connected to the lubricant returning system and a third opening in fluid communication with the tank, while in the first position the valve member blocking fluid communication through the cavity between the first opening and the second opening and between the first opening and the third opening such that the inlet of the pump is in fluid communication only with the tank, and while in the second position the valve member closing the third opening such that the inlet of the pump is in fluid communication with the lubricant returning system through the first opening and the second opening.

4. The system as claimed in claim 2 wherein the valve member is a metal ball.

5. A gravity controlled lubrication system for an engine of an aircraft, comprising:

a. a lubricant tank for containing a lubricant therein;

b. a pump having an outlet and an inlet; and c. a valve assembly including a valve body defining a cavity therein, and a valve member positioned in a first position within the cavity and moveable under the gravity thereof from the first position to a second position within the cavity when the aircraft changes to an inverted flight condition, the valve body further defining first, second, third and fourth openings therein in fluid communication with the cavity, the first opening being connected to a first tube terminating within the tank at a bottom thereof, the second opening being connected to the inlet of the pump, the third opening being connected to a lubricant returning system of the engine, and the fourth opening being in fluid communication with the inside of the tank, the valve member when being positioned in the first position dividing the cavity into isolated sections to permit a first fluid passage between the first and second openings and a second fluid passage between the third and fourth openings, respectively, the valve member when moving into the second position closing the fourth opening and permitting fluid communication within the cavity between the first, second and third openings.

6. The system as claimed in claim 5 wherein the valve assembly is positioned within the tank.

7. The system as claimed in claim 6 wherein the fourth opening is in fluid communication with an inner space within the tank above a top level of the lubricant contained in the tank during the normal flight condition.

8. The system as claimed in claim 6 further comprising a lubricant filter.

9. The system as claimed in claim 8 wherein the lubricant filter is connected between the second opening and the inlet of the pump.

10. The system as claimed in claim 6 wherein the cavity of the valve body comprises a cylindrical upper section and a lower section, the first and second openings being defined in a part of the valve body forming the lower section of the cavity and the third and fourth openings being defined in a part of the valve body forming the upper section of the cavity.

11. The system as claimed in claim 10 wherein the valve member comprises a piston element freely moveable within the cylindrical upper section of the cavity along a longitudinal axis thereof under the gravity thereof when the aircraft changes between the normal and inverted flight conditions, the piston element resting on an interface between the upper and lower sections in order to isolate the upper section from the lower section during the normal flight condition, the piston element moving towards a top wall of the cavity when the aircraft changes into the inverted flight condition.

12. The system as claimed in claim 11 wherein the fourth opening is positioned near the top wall of the cavity such that the piston element closes the fourth opening during the inverted flight condition.

13. The system as claimed in claim 11 wherein the lower section of the cavity comprises a cylindrical bottom section and a middle section between the upper and bottom sections, the cylindrical bottom section receiving a piston element freely moveable therein, the piston element in the bottom section being connected with the piston element in the upper section through a connecting rod.

14. The system as claimed in claim 13 wherein the first and second openings are defined in a part of the valve body forming the middle section of the cavity.

15. A method for continuously pumping a lubricant to a lubricant circulating system of an engine of an aircraft when the aircraft changes from a normal flight condition to an inverted flight condition, the method comprising:

a. during the normal flight condition, pumping the lubricant to the lubricant circulating system using a pump to suck the lubricant from a tank through a pump inlet passage while directing a used lubricant flow from the lubricant circulating system through a returning passage into the tank; and b. when the aircraft changes to the inverted flight condition, using a gravity controlled mechanism which includes a valve member actuated by its own weight to shift the returning passage from fluid communication with the tank to fluid communication directly with the pump inlet passage such that the pump sucks the lubricant directly from the used lubricant flow rather than from the tank.

16. The method as claimed in claim 15 wherein during the inverted flight condition, the pump inlet passage remains open to the tank such that an excess of the used lubricant flow relative to a capacity of the pump, is directed through the pump inlet passage and away from the pump to enter the tank.

17. The method as claimed in claim 15 wherein during the normal flight condition, the pump inlet passage is isolated from the returning passage and permits fluid communication therebetween only through the tank such that the pump sucks the lubricant only from the tank.

* * * * *